US005697351A

United States Patent [19]

Schumacher

[11] Patent Number: 5,697,351

[45] Date of Patent: Dec. 16, 1997

[54] POSITIVE CRANKCASE VENTILATION VALVE FOR MOTOR VEHICLE

[75] Inventor: Jeffrey A. Schumacher, Waterford, Wis.

[73] Assignee: Miniature Precision Components, Inc., Walworth, Wis.

[21] Appl. No.: 745,709

[22] Filed: Nov. 12, 1996

[51] Int. Cl.[6] ..... F02M 25/06

[52] U.S. Cl. ..... 123/574

[58] Field of Search ..... 123/574, 572, 123/573, 41.86

[56] References Cited

U.S. PATENT DOCUMENTS

| | | | |
|---|---|---|---|
| 1,693,355 | 11/1928 | Thompson . | |
| 2,481,713 | 9/1949 | Bertea . | |
| 2,742,057 | 4/1956 | Krieck . | |
| 2,744,727 | 5/1956 | Osburn . | |
| 2,926,690 | 3/1960 | Martin . | |
| 3,056,420 | 10/1962 | Dietrich . | |
| 3,111,138 | 11/1963 | Humphreys et al. . | |
| 3,359,960 | 12/1967 | Pittsley | 123/574 |
| 3,439,703 | 4/1969 | Toda et al. . | |
| 3,545,242 | 12/1970 | Horiuchi | 123/574 |
| 3,588,041 | 6/1971 | Johannisson . | |
| 3,661,128 | 5/1972 | Eshelman | 123/574 |
| 3,742,701 | 7/1973 | Feemster et al. . | |
| 3,766,898 | 10/1973 | McMullen | 123/574 |
| 3,809,111 | 5/1974 | Olsson . | |
| 4,171,712 | 10/1979 | DeForrest . | |
| 4,498,499 | 2/1985 | Knorreck et al. . | |
| 5,069,188 | 12/1991 | Cook . | |
| 5,425,397 | 6/1995 | Mackal . | |

*Primary Examiner*—Marguerite McMahon
*Attorney, Agent, or Firm*—Harness, Dickey & Pierce, P.L.C.

[57] ABSTRACT

A PCV valve for use in conjunction with an engine of a motor vehicle that reduces audible noise and increases the efficiency at which blow-by gases are routed to the engine's intake manifold to be re-burned. The PCV valve includes a housing having an inlet and an outlet. A plunger having a first end segment and a second end segment with an intermediate segment therebetween is disposed within the housing. A plunger seat disposed between the inlet and the outlet includes an orifice through which the first end segment of the plunger extends. An inlet plunger guide is disposed in the housing for receiving the second end segment of the plunger and an outlet plunger guide is disposed in the housing for receiving the first end segment of the plunger. Blow-by gases flow between the inlet and the outlet with the plunger moving axially within the housing in response to pressure changes at the outlet to control the flow rate of the gases.

20 Claims, 5 Drawing Sheets

POSITIVE CRANKCASE VENTILATION VALVE FOR MOTOR VEHICLE

BACKGROUND OF THE INVENTION

The present invention relates to a positive crankcase ventilation (PCV) valve for a motor vehicle.

The purpose of a PCV valve is to control the flow of "blow-by" gases, i.e. combustion gases that leak past an internal combustion engine piston rings, that are routed to the engine's intake manifold to be re-burned. Different types of engines have specific flow requirements to properly meter the flow of gases through their crankcases at various engine conditions. The inlet of a typical PCV valve is connected to a port on an engine, usually the valve rocker cover, through which the "blow-by" gases escape. The outlet port of the PCV valve is connected to the engine's intake manifold where the "blow-by" gases are rerouted to be re-burned. Generally, a PCV valve's flow rate is specified by the intake manifold vacuum level. A desired flow rate curve is designed to accommodate the generation of the "blow-by" gases, yet not cause excessive oxidation of the engine oil.

A typical PCV valve has a very loose fitting plunger that moves axially within a metering orifice in a housing to control the flow rate of the "blow-by" gases. Unfortunately, the plunger, particularly in a high flow valve, is free to move laterally, i.e. side-to-side, within the metering orifice in the valve. Such oscillation of the plunger causes instability in the function of the valve and is a source of audible noise. This noise is in the form of "fluttering" as the valve's flow rate abruptly changes and in the form of "tapping" of the plunger against edges of the metering orifice.

It is therefore desirable to provide a PCV valve that restricts lateral movements of a plunger within a metering orifice in the valve to increase performance and reduce audible noise.

SUMMARY OF THE INVENTION

It is therefore an object of the present invention to provide a PCV valve for use in conjunction with an engine of a motor vehicle that reduces audible noise and increases the efficiency at which "blow-by" gases are routed to the engine's intake manifold to be re-burned.

According to a preferred embodiment, the PCV valve includes a housing having an inlet and an outlet. A plunger having a first end segment and a second end segment with an intermediate segment therebetween is disposed within the housing. The housing further includes a plunger seat between the inlet and the outlet having an orifice through which the first end segment of the plunger extends. The PCV valve also includes an inlet plunger guide disposed in the inlet for receiving the second end segment of the plunger and an outlet plunger guide disposed in the outlet for receiving the first end segment of the plunger. Gases flow between the inlet and the outlet with the plunger moving axially within the housing in response to pressure changes at the outlet.

As a further feature of the present invention, the plunger seat includes a seat portion for receiving the intermediate segment of the plunger in response to a high vacuum condition at the outlet. The intermediate segment of the plunger includes at least one metering hole through which flow is choked, resulting in a constant flow of the gases flow between the inlet and outlet when the intermediate segment engages the seat portion.

According to another feature of the present invention, the PCV valve includes an annular member surrounding the first end segment of the plunger which is configured to engage an upper edge of the plunger seat in response to the absence of a vacuum at the outlet for preventing the flow of gases from the outlet to the inlet.

BRIEF DESCRIPTION OF THE DRAWINGS

Further objects, features and advantages of the present invention will become apparent to those skilled in the art from analysis of the following written description, the accompanying drawings and the appended claims in which:

DETAILED DESCRIPTION OF THE INVENTION

Figure 1:
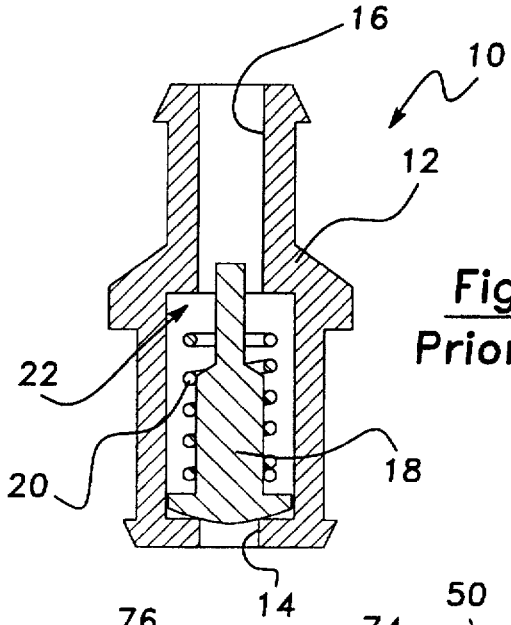
Fig-1 Prior Art
FIG. 1 is a cross-sectional view of a prior art PCV valve.

Referring to FIG. 1, a conventional positive crankcase ventilation (PCV) valve 10 is shown which is exemplary of prior art valves. Valve 10 includes a housing 12 having an inlet 14 and an outlet 16. A plunger 18 is axially disposed within housing 12. A spring 20 normally biases plunger 18 toward in a closed position, as shown. Inlet 14 is typically connected to a port on an internal combustion engine (not shown) such as the valve rocker cover while outlet 16 is connected to the engine's intake manifold. Valve 10 routes "blow-by" gases from inlet 14 through an orifice 22 formed within housing 12 to outlet 16. Plunger 18 moves axially within housing 12 to control the flow of the gases in response to the engine's intake manifold vacuum pressure existing at outlet 16.

A problem with the PCV valve 10 is that plunger 18 is free to move laterally (i.e. side to side) within housing 12. Such lateral movements of plunger 18 have been found to be a cause of instability in the function of valve 10 and a source of audible noise. Noise is generated from fluttering of plunger 18 as the gas flow through housing 12 changes abruptly as well as from plunger 18 contacting housing 12 around orifice 22. Another problem with prior art valve 10 is that the gas flow is forced to travel through spring member 20 which creates turbulence as well as noise.

Figure 2:
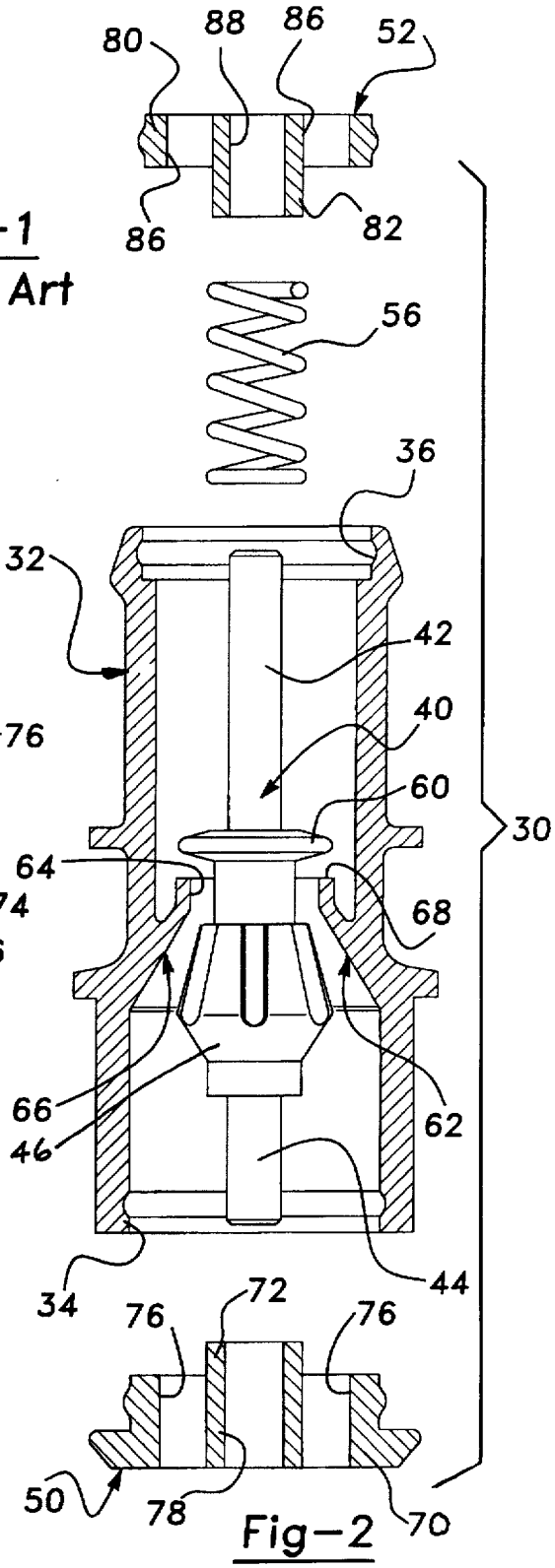
FIG. 2 is an exploded view of a PCV valve constructed according to a preferred embodiment of the present invention.

With reference to FIG. 2, an exploded cross-sectional view of a PCV valve 30 in accordance with the teachings of the present invention is shown. Valve 30 includes a housing 32 having an inlet 34 and an outlet 36 through which "blow-by" gases are routed. A plunger 40 includes a first end segment 42 and a second end segment 44 with a central or intermediate segment 46 therebetween. Plunger 40 is disposed and supported axially within housing 32 by an inlet plunger guide 50 and an outlet plunger guide 52. Inlet plunger guide 50 receives and guides axial movement of second end segment 44 of plunger 40. Likewise, outlet plunger guide 52 receives and guides axial movement of first end segment 42 of plunger 40. A coil spring 56 surrounds a portion of first end segment 42 of plunger 40 between outlet plunger guide 52 and an annular backfire suppression ring 60. First end segment 42 of plunger 40 extends through a plunger seat 62 disposed in housing 12 between inlet 34 and outlet 36. Plunger seat 62 includes an orifice 64 through which first end segment 42 of plunger extends. Plunger seat 62 also includes a seat portion 66 configured to receive intermediate segment 46 of plunger 40 therein. Additionally, plunger seat 62 includes an upper edge surface 68 configured to engage backfire suppression ring 60 for sealing orifice 64 when gas pressure at outlet 36 exceeds the pressure at the inlet 34. Plunger seat 62 can be formed integrally with housing 32 (as shown) or, in the alternative, be made as a separate component fixedly secured within housing 32.

In a typical application, inlet 34 is connected to a port associated with an internal combustion engine, usually the valve rocker cover, such that "blow-by" gases flow through inlet 34 and exit through outlet 36. Outlet 36 is, in turn, coupled to the intake manifold of the engine. Plunger 40 moves axially within housing 32 in response to pressure changes at outlet 36 generated by the intake manifold of the engine to control the flow of the "blow-by" gases.

Figure 3:
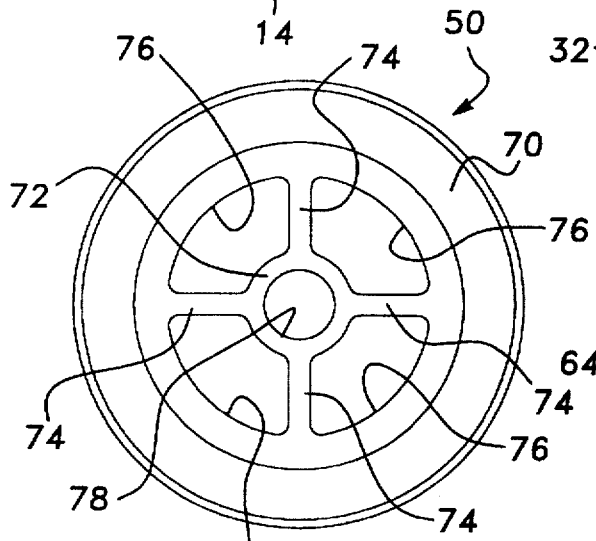
FIG. 3 is a plan view of an inlet plunger guide used with the PCV valve shown in FIG. 2.

Turning to FIG. 3, an enlarged plan view of inlet plunger guide 50 is shown. Inlet plunger guide 50 includes an outer ring portion 70 that is interconnected to an inner guide portion 72 by a plurality of radially-extending arm members 74. A series of openings or inlet passages 76 are formed between arm members 74, outer ring portion 70 and inner guide portion 72 such that the "blow-by" gases freely flow into housing 32. Second end segment 44 of plunger 40 is adapted to slide within a central aperture 78 formed in inner guide portion 72 of inlet plunger guide 50.

Figure 4:
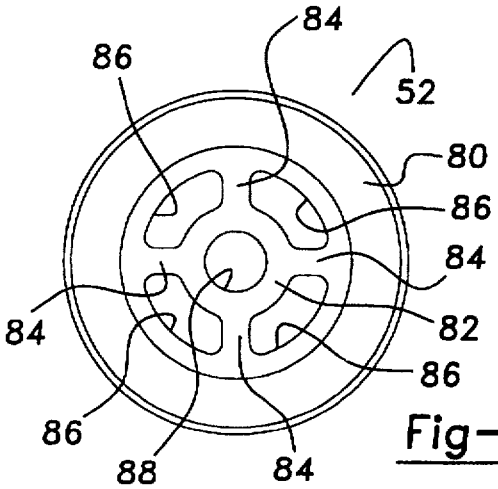
FIG. 4 is a plan view of an outlet plunger guide used with the PCV valve shown in FIG. 2.

Referring now to FIG. 4, a plan view of outlet plunger guide 52 is shown. As with inlet plunger guide 50, outlet plunger guide 52 includes an outer ring portion 80 interconnected to an inner guide portion 82 by a plurality of arm members 84. Openings or outlet passages 86 are formed between arm members 84, outer ring portion 80 and inner guide portion 82 such that gases freely flow out of housing 32. First end segment 42 of plunger 40 is adapted to slide within a central aperture 88 formed in inner guide portion 82 of outlet plunger guide 52.

Preferably, inlet plunger guide 50 and outlet plunger guide 52 are formed from a suitable plastic material such as, but not limited to, nylon and are snap or press fitted into inlet 34 and outlet 36. In operation, outlet and inlet plunger guides 52 and 50 prohibit plunger 40 as well as coil spring 56 from moving laterally within metering orifice 64, thereby making the flow control characteristics of valve 30 more stable. This also reduces the audible noise during operation of valve 30. Another advantage associated with the use of inlet and outlet plunger guides 50 and 52 is that they reduce the wear of plunger 40 as well as plunger seat 62.

Figure 5A:
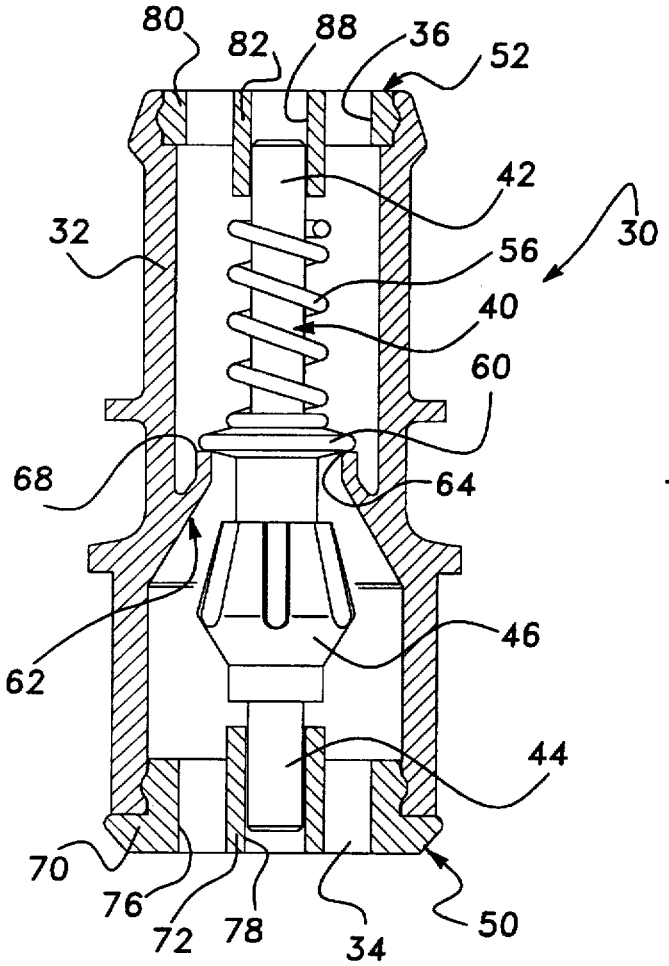
FIG. 5*a* is a cross-sectional view of the PCV valve in a closed position.
Figure 5B:
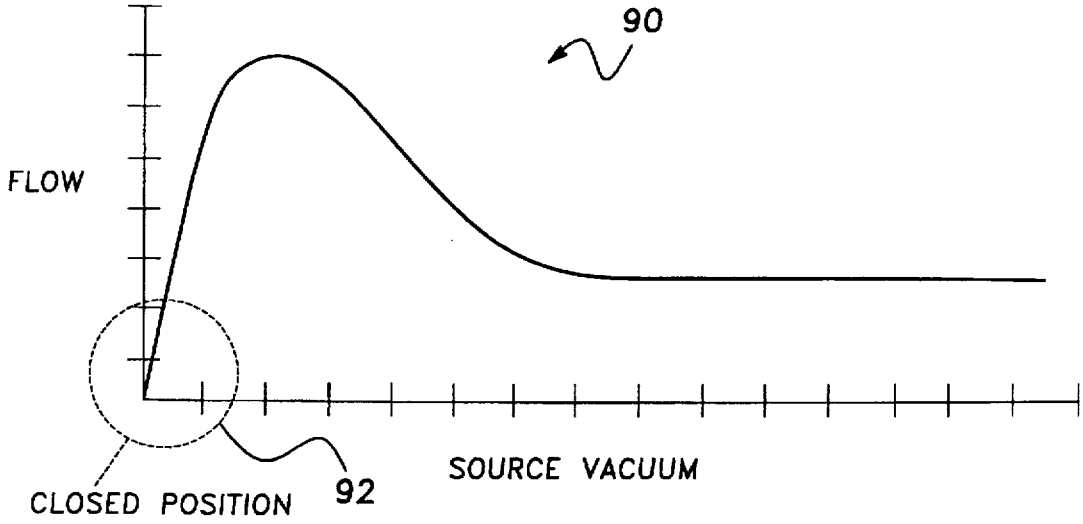
FIG. 5*b* is a graph illustrating the flow rate through the PCV valve in its closed position.

With reference now to FIGS. 5*a* and 5*b*, a cross-sectional view of valve 30 in a closed position and a graph 90 illustrating a flow curve for valve 30 are shown. Valve 30 is in its closed position when there is no vacuum pressure at outlet 36 due to the engine being turned off. With valve 30 in its closed position, plunger 40 is biased by coil spring 56 such that backfire suppression ring 60 engages upper edge surface 68 of plunger seat 62, whereby the flow of crankcase gases is not permitted. Additionally, backfire suppression ring 60 prevents a backfire in the intake manifold from causing reverse flow of gases through orifice 64. Graph 90 illustrates the flow curve for the valve 30 with section 92 highlighting the portion of graph 90 when valve 30 is in the closed position.

Figure 6A:
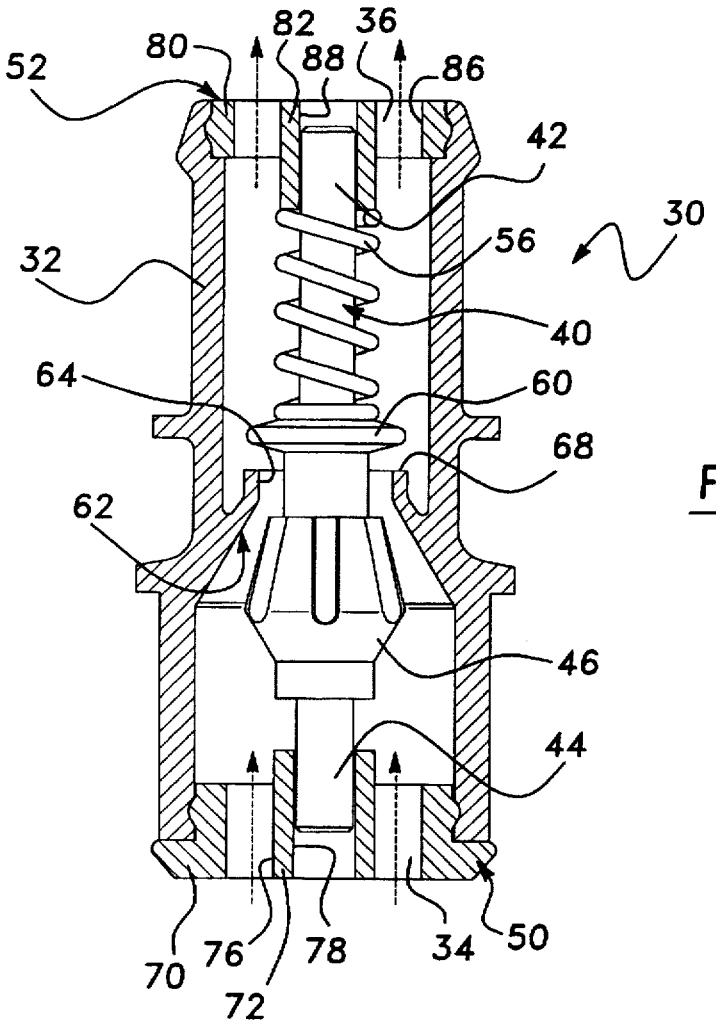
FIG. 6*a* is a cross-sectional view of the PCV valve in a fully open position.
Figure 6B:
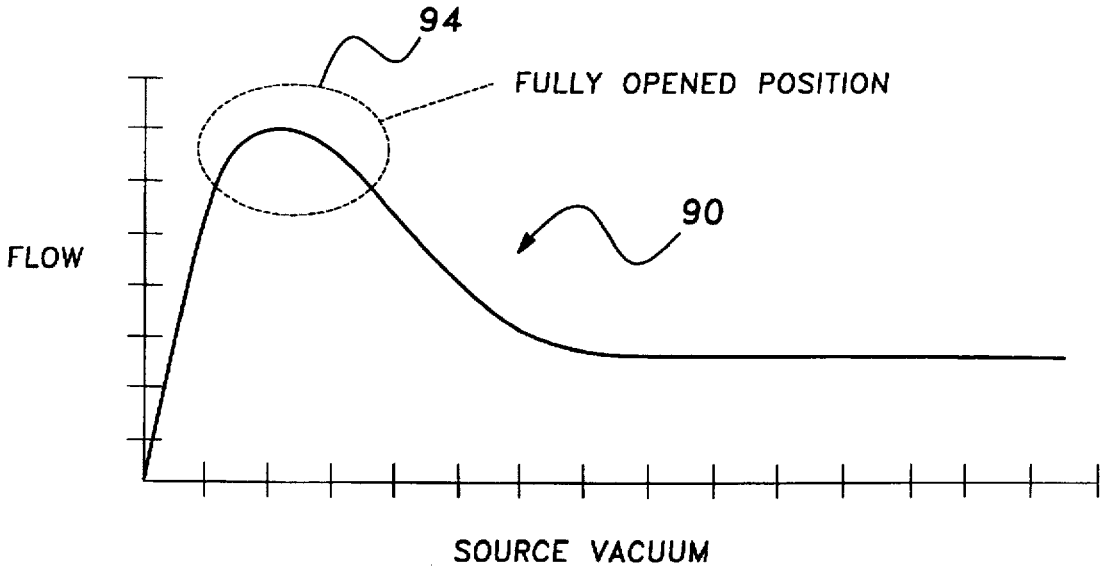
FIG. 6*b* is a graph highlighting the flow curve for the PCV valve in its fully open position.

With reference to FIGS. 6*a* and 6*b*, a cross-sectional view of valve 30 in a fully opened position and graph 90 illustrating the flow rate is shown. Plunger 40 has moved axially within housing 12 in response to a low vacuum condition existing at outlet 36 due to engine acceleration or heavy loads, whereby valve 30 permits optimum flow of "blow-by" gases through the crankcase. As shown, the gases enter inlet 34 through inlet openings 76 in inlet plunger guide 50 and exit through outlet plunger guide 36 through outlet openings 86. Again graph 90 illustrates the flow curve for valve 30 with section 94 highlighting the portion of graph 90 when valve 30 is in the fully opened position with the maximum flow through valve 30 occurring.

Figure 7A:
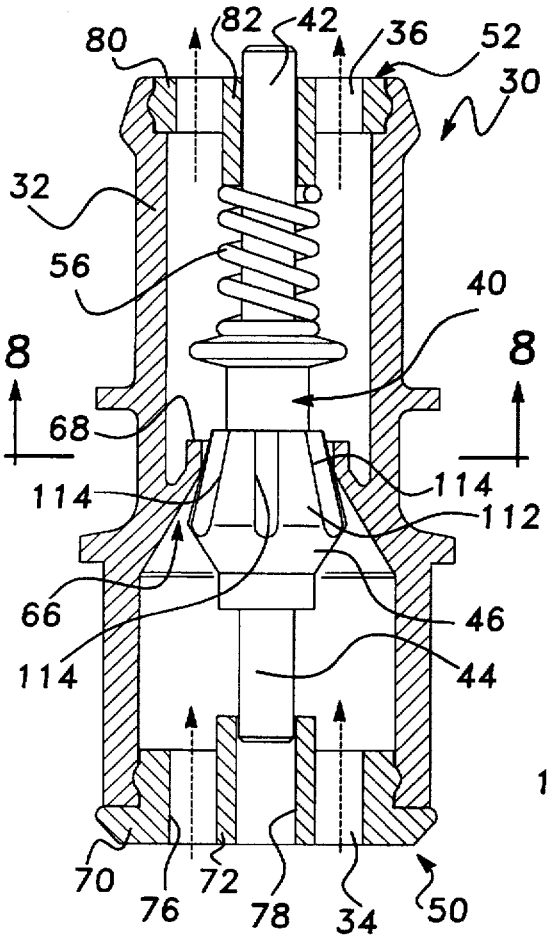
FIG. 7*a* is a cross-sectional view of the PCV valve in a choked flow position.
Figure 7B:
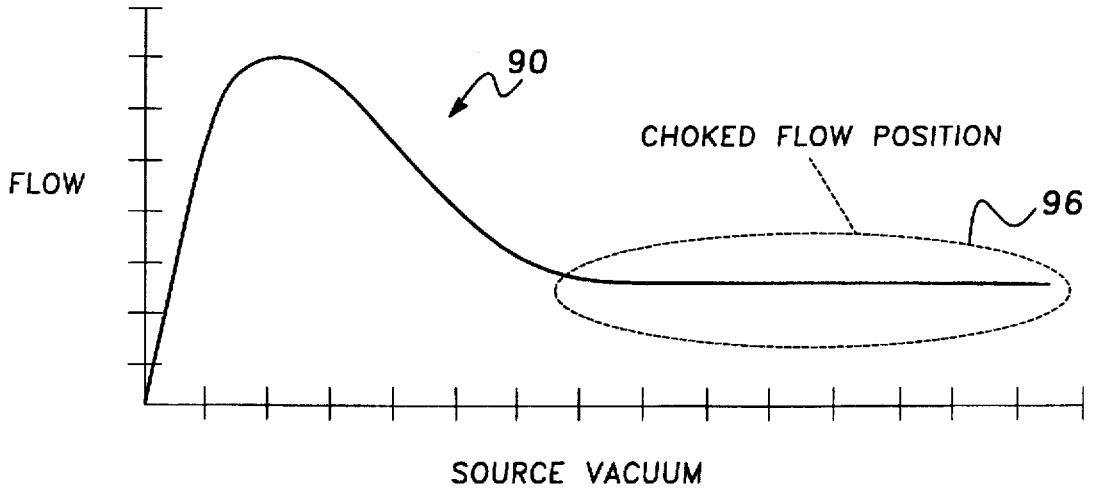
FIG. 7*b* is a graph illustrating the flow curve for the PCV valve in its choked flow position.

Turning to FIGS. 7*a* and 7*b*, a cross-sectional view of the valve 30 in a choked flow position and graph 90 highlighting the flow through valve 30 during the choked position is shown. The choked position results when a high vacuum condition exists, such as during deceleration of the engine and engine idle. As illustrated, a tapered outer surface 112 of intermediate segment 46 of plunger 40 engages seat portion 66 of plunger seat 62. Tapered surface 112 includes a plurality of metering slots 114 formed therein for maintaining choked flow resulting in a constant flow rate through housing 12 regardless of any increases in the vacuum existing at outlet 36. Graph 90 illustrates the flow curve for valve 30 with section 96 highlighting the portion thereof when valve 30 is in its choked flow position.

Figure 8:
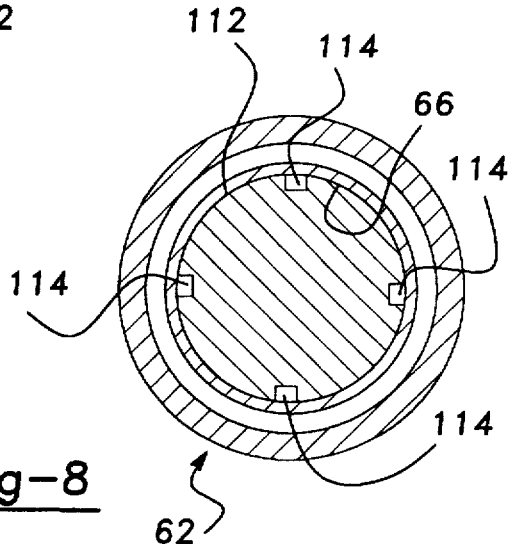
FIG. 8 is a cross sectional view taken along line 8—8 of FIG. 7*a* illustrating the metering slots formed in the plunger.

Turning to FIG. 8, a cross-section view taken through line 8—8 of FIG. 7*a* is shown. Tapered surface 112 is shown engaging seat portion 66 of plunger seat 62. Metering slots 114 are shown providing a passageway for gases to flow between inlet 34 and outlet 36. As will be apparent to one skilled in the art, the number and configuration of metering slots 114 may be varied for a particular application such that the flow rate through valve 30 is adjusted.

As will be apparent to one skilled in the art, inlet and outlet plunger guides 50 and 52 are adapted to support plunger 40 within housing 32 during all modes of operation of valve 30. As such, the performance of valve 30 is improved as well as a reduction in the noise generated during operation of valve 30 is greatly reduced compared to prior art valve 10.

Figure 9:
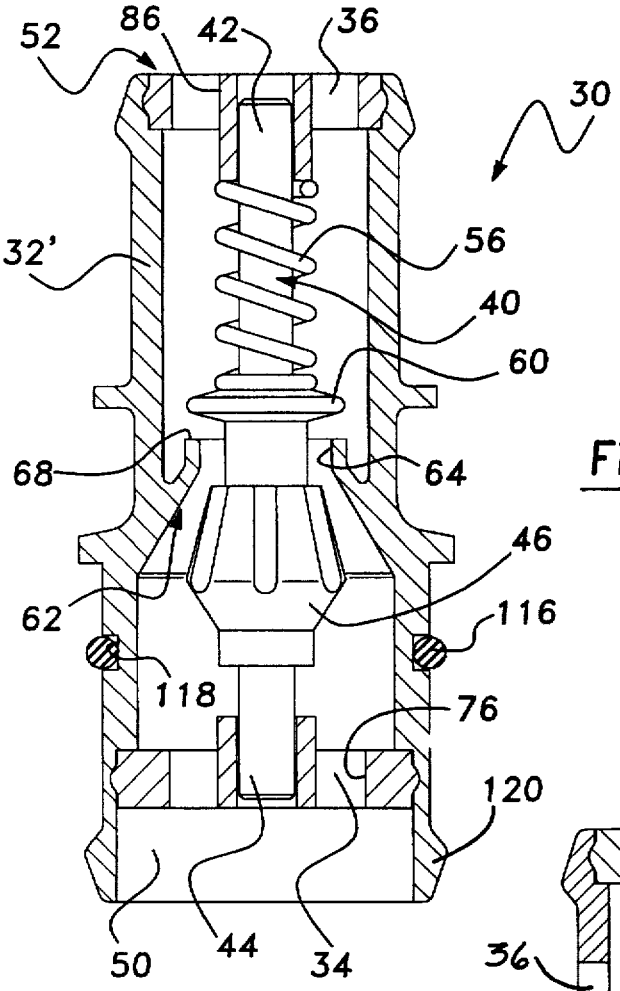
FIG. 9 is a cross-sectional view of an alternate preferred embodiment of a PCV valve of the present invention.

With reference to FIG. 9, PCV valve 30 is shown to include a slightly modified housing 32' and an o-ring seal 116 retained in a groove 118 formed in the outer surface of housing 32'. Housing 32' includes an axial extension segment 120 that projects beyond inlet plunger guide 50. O-ring seal 116 is adapted to seal inlet 34 in a manner to inhibit the flow of blow-by gases between the interface of valve 30 and the engine port in which valve 30 is secured.

Figure 10:
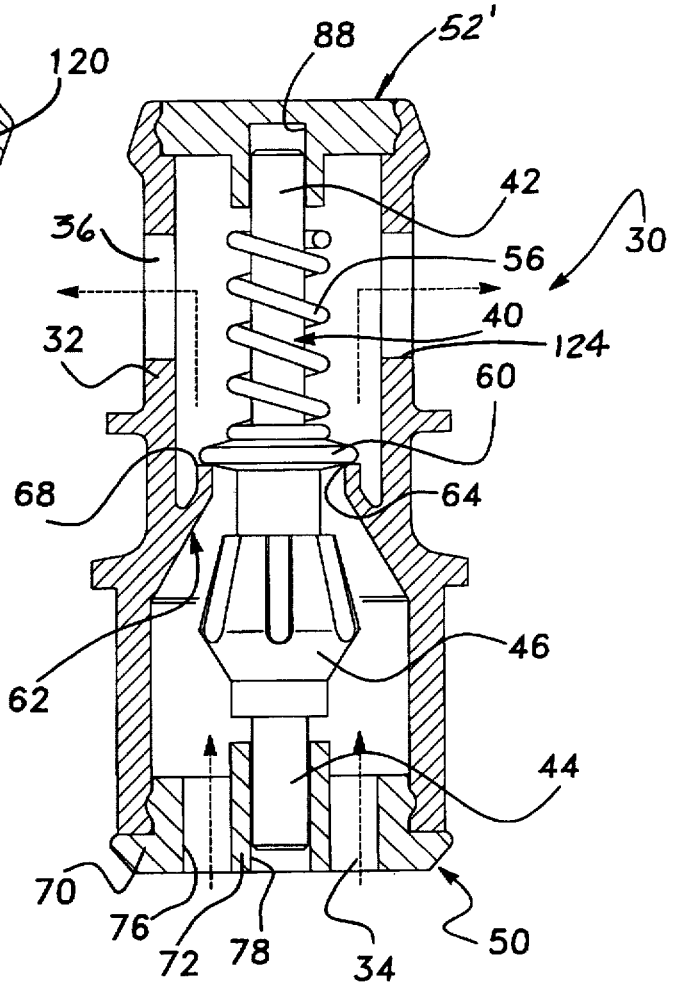
FIG. 10 is a cross-sectional view of yet another alternate preferred embodiment of a PCV valve of the present invention.

With reference to FIG. 10, PCV valve 30 is shown in yet another modified embodiment wherein outlet 36' now extends through a series of radial outlet ports 124 formed through housing 32 and wherein outlet plunger guide 52' is a cap member with no outlet passages 76 formed therein. The number and size of outlet ports 124 can be selected based on each particular valve application.

The foregoing discussion discloses and describes the various alternative preferred structures for the present invention. However, one skilled in the art will readily recognize from such discussion, and from the accompanying drawings and claims, that various changes, modifications and variations can be made therein without departing from the true spirit and fair scope of the invention as defined in the following claims.

What is claimed is:

1. A positive crankcase ventilation valve, comprising:

a housing having an inlet and an outlet;

a plunger having a first end segment and a second end segment with an intermediate segment therebetween;

an inlet plunger guide disposed in said inlet for receiving said second end segment of said plunger; and an outlet plunger guide disposed in said outlet for receiving said first end segment of said plunger, whereby gas flows between said inlet and said outlet with said plunger moving axially within said housing in response to pressure changes at said outlet.

2. The positive crankcase ventilation valve of claim 1 further comprising a plunger seat secured to said housing and disposed between said inlet and said outlet, said plunger seat having an orifice through which said first end segment of said plunger extends.

3. The positive crankcase ventilation valve of claim 2 wherein said plunger seat includes a seat portion for receiving said intermediate segment of said plunger in response to a high vacuum condition at said outlet, said intermediate segment of said plunger including at least one metering slot through which flow is choked to permit a constant flow of the gas between said inlet and said outlet when said intermediate segment engages said seat portion.

4. The positive crankcase ventilation valve of claim 2 further comprising an annular member surrounding aid first end segment of plunger, said annular member engages an upper edge of said plunger seat in response to the absence of a vacuum at said outlet such that a flow of gas from said outlet to said inlet is prevented.

5. The positive crankcase ventilation valve of claim 1 further comprising a biasing spring member secured to said first end segment of said plunger between said outlet plunger guide and said intermediate segment of said plunger for biasing said plunger toward a closed position within said housing.

6. The positive crankcase ventilation valve of claim 1 wherein said outlet plunger guide includes an outer ring portion coupled to an inner guide portion by a plurality of arm members with outlet passages therebetween, whereby said outer ring portion engages said outlet and said inner guide portion receives and prevents lateral movements of said first end segment of said plunger member.

7. The positive crankcase ventilation valve of claim 1 wherein said inlet plunger guide includes an outer ring portion coupled to an inner guide portion by a plurality of arm members with inlet passages therebetween, whereby said outer ring portion engages said inlet and said inner guide portion receives and prevents lateral movements of said second end segment of said plunger member.

8. The positive crankcase ventilation valve of claim 2 wherein said intermediate segment of said plunger includes a tapered surface with a plurality of metering slots formed therein for engaging a seat portion of said plunger seat in response to a high vacuum condition at said outlet, whereby a constant flow of the gas flows between said inlet and said outlet when said tapered surface engages said seat portion.

9. The positive crankcase ventilation valve of claim 1 further comprising an o-ring member surrounding said housing.

10. A positive crankcase ventilation valve for controlling the flow of blow-by gases of an engine, comprising:

a housing having an inlet and an outlet;

a plunger having a first end segment and a second end segment with an intermediate segment therebetween;

a plunger seat disposed between said inlet and said outlet, said plunger seat having an orifice through which said first end segment of said plunger extends and a seat portion for receiving said intermediate segment of said plunger in response to a choked vacuum condition at said outlet;

an inlet plunger guide disposed in said housing for receiving said second end segment of said plunger; and an outlet plunger guide disposed in said housing for receiving said first end segment of said plunger, wherein said inlet is coupled to a crankcase of the engine and said outlet is coupled to an intake manifold of the engine such that the blow-by gases flows between said inlet and said outlet with said plunger moving axially within said housing in response to pressure changes at said outlet.

11. The positive crankcase ventilation valve of claim 10 further comprising an annular member surrounding said first end segment of said plunger, said annular member engages an upper edge of said plunger seat in response to the absence of a vacuum at said outlet such that a flow of gas from said outlet to said inlet is prevented.

12. The positive crankcase ventilation valve of claim 11 further comprising a biasing spring member surrounding said first end segment of said plunger between said outlet plunger guide and said annular member for biasing said plunger toward a closed position with said annular member engaging said upper edge of said plunger seat.

13. The positive crankcase ventilation valve of claim 10 wherein said outlet plunger guide includes an outer ring portion coupled to an inner guide portion by a plurality of arm members with outlet passages therebetween that are in communication with the intake manifold of the engine, whereby said outer ring portion engages said outlet and said inner guide portion receives and prevents lateral movements of said first end segment of said plunger.

14. The positive crankcase ventilation valve of claim 13 wherein said inlet plunger guide includes an outer ring portion coupled to an inner guide portion by a plurality of arm members with inlet passages therebetween that are in communication with the crankcase of the engine, whereby said outer ring portion engages said inlet and said inner guide portion receives and prevents lateral movements of said second end segment of said plunger.

15. The positive crankcase ventilation valve of claim 10 wherein said intermediate segment of said plunger includes a tapered surface with a plurality of metering holes formed therein for engaging said seat portion of said plunger seat in response to a high vacuum condition at said outlet, whereby a constant flow of the gas flows between said inlet and said outlet when said intermediate segment engages said seat portion.

16. The positive crankcase ventilation valve of claim 14 wherein said outer ring portion of said outlet plunger guide frictionally fits within a recess formed in said outlet of said housing and wherein said outer ring portion of said inlet guide portion frictionally fits within a recess formed in said inlet of said housing with said plunger disposed therebetween.

17. The positive crankcase ventilation valve of claim 10 wherein said plunger seat is integral with said housing.

18. A positive crankcase ventilation valve, comprising:

a housing having an inlet and an outlet;

a plunger having a first end segment and a second end segment with an intermediate segment therebetween;

a plunger seat disposed between said inlet and said outlet having an orifice through which said first end segment of said plunger extends and a seat portion for receiving said intermediate segment portion of said plunger in response to a high vacuum condition at said outlet;

an inlet plunger guide disposed in said housing for receiving said second end segment of said plunger;

an outlet plunger guide disposed in said housing for receiving said first end of said plunger;

an annular member surrounding said first end segment of said plunger for engaging an upper edge of said plunger seat in response to the absence of a vacuum at said outlet such that a flow of gas from said outlet to said inlet is prevented; and a biasing spring member surrounding said first end segment of said plunger between said outlet plunger guide and said annular member for biasing said plunger toward a closed position whereat said annular member engages said upper edge of said plunger seat, whereby gas flows between said inlet and said outlet with said plunger moving axially within said housing in response to pressure changes at said outlet.

19. The positive crankcase ventilation valve of claim 18 wherein said outlet plunger guide includes an outer ring portion coupled to an inner guide portion by a plurality of arm members with outlet passages therebetween communicating with said outlet, whereby said outer ring portion engages said outlet and said inner guide portion receives and prevents lateral movements of said first end segment of said plunger.

20. The positive crankcase ventilation valve of claim 19 wherein said inlet plunger guide includes an outer ring portion coupled to an inner guide portion by a plurality of arm members with inlet passages therebetween communicating with said inlet, whereby said outer ring portion engages said inlet and said inner guide portion receives and prevents lateral movements of said second end segment of said plunger.

* * * * *